US008312834B2

(12) United States Patent
Friske et al.

(10) Patent No.: US 8,312,834 B2
(45) Date of Patent: Nov. 20, 2012

(54) APPARATUS FOR APPLYING THIN COATING

(75) Inventors: Gordon W. Friske, Rockford, IL (US); David Widman, Loves Park, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 1904 days.

(21) Appl. No.: 11/106,404

(22) Filed: Apr. 14, 2005

(65) Prior Publication Data

US 2006/0231021 A1 Oct. 19, 2006

(51) Int. Cl.
*B05C 1/06* (2006.01)
*B05D 3/12* (2006.01)

(52) U.S. Cl. ..... 118/261; 427/356

(58) Field of Classification Search ..... 427/356, 427/428.03–428.17, 8, 428; 118/261, 413, 118/679; 101/365, DIG. 47
See application file for complete search history.

(56) References Cited

U.S. PATENT DOCUMENTS

| | | | | | |
|---|---|---|---|---|---|
| 2,187,421 | A * | 1/1940 | George | 101/157 |
| 2,837,024 | A * | 6/1958 | Dougan | 101/365 |
| 3,026,842 | A * | 3/1962 | Faeber | 118/261 |
| 3,070,066 | A * | 12/1962 | Faeber | 118/413 |
| 3,081,191 | A * | 3/1963 | Smith et al. | 427/369 |
| 3,186,377 | A * | 6/1965 | Schuessier | 118/672 |
| 3,978,788 | A * | 9/1976 | Cappel et al. | 101/363 |
| 4,133,917 | A * | 1/1979 | Wallsten | 427/209 |
| 4,245,583 | A | 1/1981 | Schollkopf et al. | |
| 4,310,573 | A | 1/1982 | Damrau | |
| 4,366,754 | A * | 1/1983 | Sarda | 101/208 |
| 4,393,775 | A * | 7/1983 | Cappel et al. | 101/365 |
| 4,485,132 | A | 11/1984 | Furuzono et al. | |
| 4,548,840 | A | 10/1985 | States et al. | |
| 4,899,687 | A * | 2/1990 | Sommer et al. | 118/126 |
| 5,286,526 | A * | 2/1994 | Rantanen et al. | 427/356 |
| 5,529,806 | A * | 6/1996 | Eriksson | 427/356 |
| 5,567,479 | A | 10/1996 | Rantanen | |
| 5,624,495 | A * | 4/1997 | Trefz et al. | 118/122 |
| 5,738,724 | A * | 4/1998 | Metzler | 118/123 |
| 5,746,833 | A * | 5/1998 | Gerhardt | 118/665 |
| 5,980,634 | A * | 11/1999 | Tomatis | 118/118 |
| 6,074,480 | A | 6/2000 | Kakuta | |
| 6,132,807 | A * | 10/2000 | Hess et al. | 427/356 |
| 6,565,658 | B2 * | 5/2003 | Fischer et al. | 118/259 |
| 6,589,598 | B2 | 7/2003 | Ochiai et al. | |
| 2004/0096585 | A1 | 5/2004 | Bonnebat et al. | |

* cited by examiner

*Primary Examiner* — Yewebdar Tadesse
*Assistant Examiner* — Charles Capozzi
(74) *Attorney, Agent, or Firm* — Carlson, Gaskey & Olds PC

(57) ABSTRACT

A coating apparatus includes a coating transfer roll that transfers a coating material from a coating material reservoir to a work piece. The coating material reservoir is formed between the coating transfer roll, a flexible blade and reservoir wall members. The flexible blade includes a first section that is fixed to a support. A second section of the flexible blade extends along a length of the coating transfer roll and is rotatable about the first section. An actuator selectively applies a pressure on the flexible blade during a coating operation to deflect the flexible blade and control a thickness of the coating material applied to the work piece.

14 Claims, 2 Drawing Sheets

APPARATUS FOR APPLYING THIN COATING

BACKGROUND OF THE INVENTION

This invention relates to application of coatings and, more particularly, to a roller coating apparatus for applying an adhesive coating to a work piece.

Stacked steel sheets (e.g., discs) are used in electric motors and generators to support magnetic windings and insulation. In operation, an electric current through the magnetic windings produces a magnetic field to actuate a rotor. The magnetic field passes at least partially through the stacked steel sheets that are secured together by welding or an adhesive. Disadvantageously, welded stacked steel sheets may short out the magnetic windings and current methods of applying the adhesive to the steel sheets may result in inconsistent adhesive thicknesses. Variation in adhesive thickness may result in residual stress on the stacked sheets which in turn may lead to magnetic field loss when the magnetic field passes through the stacked steel sheets.

Coating machines are used to apply a coating of the adhesive to a surface of each steel sheet before stacking the sheets together. A coating machine includes a conveyor that moves a steel sheet that is to be coated into contact with a rolling surface of a rotating applicator roll. Before contacting the steel sheet, the rolling surface picks up a coating material from a wetting container as the applicator roll rotates. A doctor blade then scrapes the rolling surface to remove excess coating material and control a coating material thickness before the applicator roll transfers the coating material to the steel sheet.

Disadvantageously, the removed excess coating material often overflows from the doctor blade, is difficult to contain and clean-up, and the scraping force of the doctor blade against the applicator roll often wears out the doctor blade in relatively short periods of time. The wear on the doctor blade may result in inconsistent coating material thickness that may ultimately lead to residual stress in the steel sheets.

Accordingly, a coating apparatus that applies material of consistent thickness while minimizing blade wear is desired. This invention addresses those needs and provides enhanced capabilities while avoiding the shortcomings and drawbacks of the prior art.

SUMMARY OF THE INVENTION

The coating apparatus according to the present invention includes a support roller that supports a work piece as it is coated. A coating transfer roll transfers coating material from a coating material reservoir to the work piece. The coating material reservoir is formed between the coating transfer roll, a flexible blade and reservoir wall members. The flexible blade includes a first section that is fixed to a support. A second section of the flexible blade extends along a length of the coating transfer roll and is rotatable about the first end portion. An actuator selectively applies a pressure on the flexible blade during a coating operation to control a thickness of the coating material applied to the work piece.

The pressure exerted on the flexible blade deflects the flexible blade from an essentially flat configuration to a curved configuration. The coating transfer roll rotates at a predetermined rotational speed and produces a shear force on the coating material in the coating material reservoir. The shear force draws the coating material between the coating transfer roll and the flexible blade which allows a thin layer of coating material to be transferred from the coating material reservoir along the coating transfer roll to the work piece.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
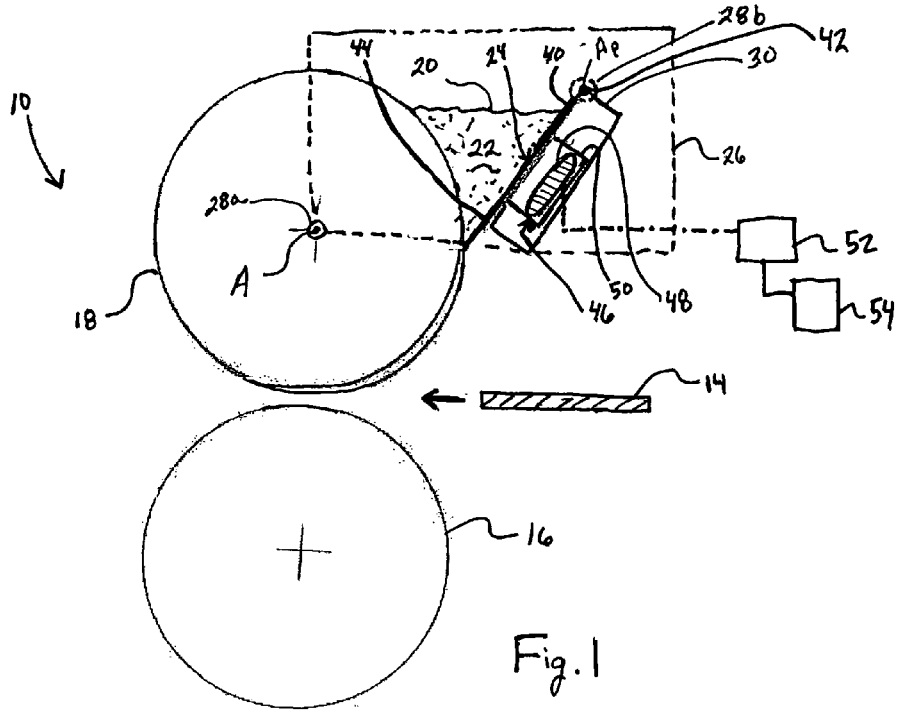
FIG. 1 is a schematic cross-sectional view of a coating apparatus according to the present invention, prior to a coating operation.
Figure 2:
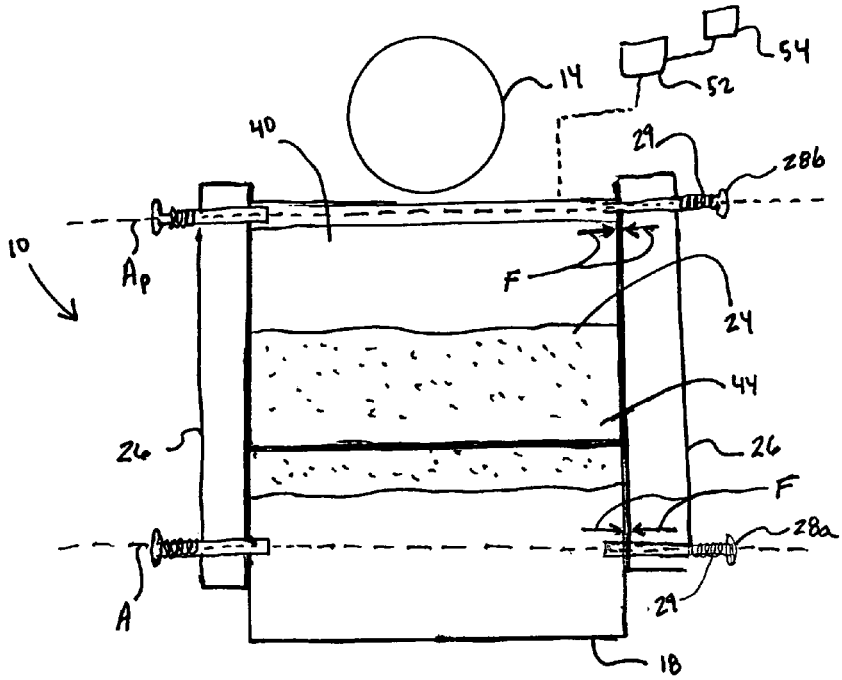
FIG. 2 is a schematic top view of the coating apparatus according to FIG. 1.

FIGS. 1 and 2 respectively illustrate a cross-sectional view and a top view of a coating apparatus 10 for applying a coating material 12 to a work piece 14, such as a steel sheet or disc for a motor or generator. The coating apparatus 10 includes a support roller 16 that supports the work piece 14 as it is coated. A coating transfer roll 18 transfers coating material 20 from a coating material reservoir 22 to the work piece 14. The coating material reservoir 22 is formed between the coating transfer roll 18, a flexible blade 24 and reservoir wall members 26 (one shown in phantom in FIG. 1).

A first bias member 28*a* secures the reservoir wall member 26 to the coating transfer roll 18 along an axis of rotation A of the coating transfer roll 18. A second bias member 28*b* secures the reservoir wall member 26 to a support 30 along an axis $A_p$. The bias members 28*a* and 28*b* hold the reservoir wall member 26 against the coating transfer roll 18 and flexible blade 24 to form the coating material reservoir 22.

The bias members 28*a* and 28*b* preferably include spring-loaded fasteners 29 that continually provide a force as illustrated by the arrows F (FIG. 2). The force F maintains continuous contact between the reservoir wall members 26, the coating transfer roll 18 and the flexible blade 24, as the coating transfer roll 18 rotates. The continuous contact produces a dynamic seal between the reservoir wall members 26 and the coating transfer roll 18. That is, the reservoir wall members 26 seal against the coating transfer roll 18 as the coating transfer roll 18 rotates. The dynamic seal prevents significant leakage of the coating material 20 from the coating material reservoir 22.

Preferably, the reservoir wall members 26 are manufactured of a low-friction polymer material, such as polytetrafluoroethylene. During a coating operation, the rotation of the coating transfer roll 18 generates frictional contact between the coating transfer roll 18 and the reservoir wall members 26. The low friction polymer material reduces frictional wear with the reservoir walls members 26. This provides the advantage of maintaining the dynamic seal between the reservoir wall members 26 and the coating transfer roll 18 without grinding away a portion of the reservoir wall members 26 to form a gap between the reservoir wall members 26 and the coating transfer roll 18.

The flexible blade 24 includes a first section 40 fixed to the support 30 along the axis $A_p$ and a second section 44 that extends at an angle towards the coating transfer roll 18 along a longitudinal length (FIG. 2) of the coating transfer roll 18. The second section 44 initially contacts the coating transfer roll 18 with minimal force before a coating operation begins, to prevent the coating material in the reservoir 22 from escaping. Alternatively, the second section 44 is spaced a distance from the coating transfer roll 18 before the coating operation begins. The distance is typically small enough to prevent a significant amount of coating material 20 from flowing through, however, it is to be understood that this depends on the viscosity of the coating material and the magnitude of the distance.

The support 30 includes an actuator 46 that selectively applies a pressure to the flexible blade 24 during a coating operation, as will be described below. The actuator 46 preferably includes a pressurizable chamber 48, such as a bladder, contained within a housing 50. The pressurizable chamber 48 is fluidly connected to a fluid source 52 and a control 54. The control 54 selectively pressurizes or depressurizes the pressurizable chamber 48 with a fluid, such as air, to respectively expand or contract the pressurizable chamber 48.

Figure 3:
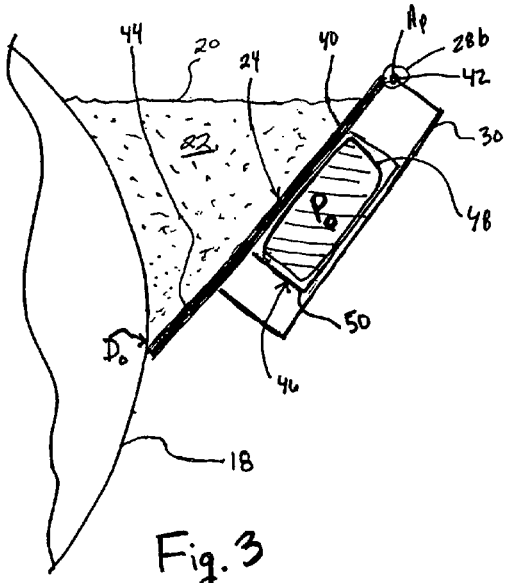
FIG. 3 is a schematic view of a flexible blade, prior to the coating operation.

Before the coating operation begins, the actuator 46 does not exert pressure on the flexible blade 24, as illustrated in FIG. 3. In this condition, the flexible blade 24 is in a flat configuration and there is a zero distance $D_0$ between the coating transfer roll 18 and the second section 44 of the flexible blade 24.

Figure 4:
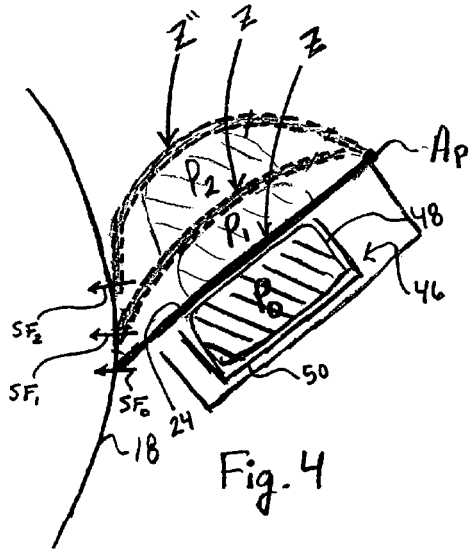
FIG. 4 is a schematic view of the flexible blade deflecting under different applied pressures from an actuator.

FIG. 4 illustrates deflection of the flexible blade 24 as the actuator 46 exerts increasing pressures on the flexible blade 24. Increasing the pressure from $P_0$ to $P_1$ deflects the flexible blade from a generally flat configuration Z to a first curved configuration Z'. Increasing the pressure from $P_1$ to $P_2$ further deflects the flexible blade 24 from the first curved configuration Z' to a second curved configuration Z". As the flexible blade 24 deflects, the second section 44 of the flexible blade 24 pivots (upwards in FIG. 4) relative to the axis $A_p$. It will be appreciated, that as the flexible blade 24 deflects from Z to Z' to Z", the flexible blade 24 exerts increasing amounts of spring force $SF_0$, $SF_1$, and $SF_2$ against the coating transfer roll 18.

The flexible blade 24 is preferably manufactured of a flexible steel sheet, which allows the flexible blade 24 to deflect as illustrated in FIG. 4. The flexible steel sheet has a nominal thickness between 0.01 inches and 0.03 inches. One of ordinary skill in the art will appreciate that, although a thickness range is listed, the thickness may vary above or below the range depending on the particular type of metal selected for the flexible blade 24. In the disclosed example, a flexible steel sheet having a thickness between 0.018 inches and 0.022 inches provides a balance between stiffness and flexibility for selected known thermoset coating materials.

The nominal thickness of the flexible steel sheet allows the flexible blade 24 to deflect between the flat configuration Z and the first and second curved configurations Z' and Z". The amount of pressure required to deflect the flexible steel sheet a desired amount corresponds to the thickness of the flexible steel sheet. That is, a relatively thicker flexible steel sheet will require a higher pressure to deflect a desired amount, and a relatively thinner flexible steel sheet will require a lower pressure to deflect the same desired amount.

Figure 5:
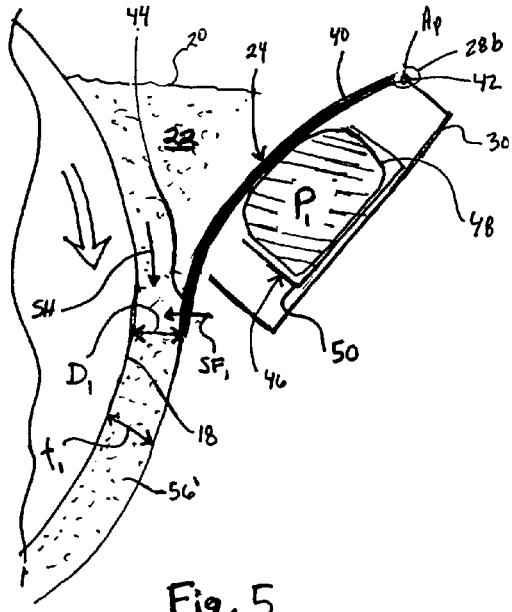
FIG. 5 is a schematic view of the flexible blade during a coating operation utilizing a first pressure $P_1$.

The deflection of the flexible blade 24 causes the flexible blade 24 to exert a spring force against the coating transfer roll 18. During a coating operation (FIG. 5), the coating transfer roll 18 rotates at a predetermined rotational speed and produces a shear force SH on the coating material 20 in the coating material reservoir 22. The shear force SH mixes the coating material and draws the coating material towards the second section 44. The shear force SH on the coating material 20 opposes the spring force $SF_1$ produced by the pressure $P_1$ exerted on the flexible blade 24 and moves the flexible blade 24 away from the coating transfer roll 18. This causes a spaced distance $D_1$ between the coating transfer roll 18 and the second section 44 that allows a layer 56' of coating material 20 having a thickness of $t_1$ to be transferred from the coating material reservoir 22 along the coating transfer roll 18 to the work piece 14.

Figure 6:
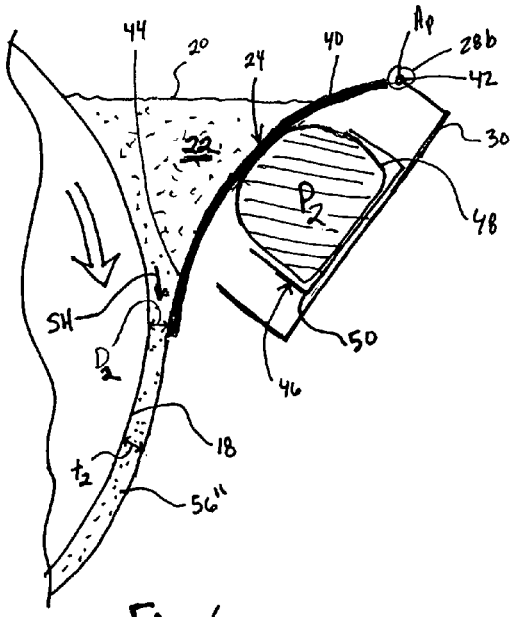
FIG. 6 is a schematic view of the flexible blade during a coating operation utilizing a second pressure $P_2$.

FIG. 6 illustrates a coating operation using the higher pressure $P_2$ instead of $P_1$. Under this higher pressure, the flexible blade 24 exerts a higher spring force $SF_2$ towards the coating transfer roll 18. The shear force SH opposes the spring force $SF_2$; however, because the spring force $SF_2$ is higher than the spring force $SF_1$ produced by the lower pressure $P_1$, the shear force SH moves the flexible blade 24 a shorter distance $D_2$ away from the coating transfer roll 18. This produces a layer 56" having a thickness $t_2$ that is less than the thickness $t_1$. The layer 56" produced using the higher pressure $P_2$ is thinner than the layer 56' produced using the lower pressure $P_1$. That is, the thickness of the layer corresponds to the amount of pressure exerted on the flexible blade 24.

The rotational speed of the coating transfer roll 18 is also utilized to control the thickness of the layer 56. A relatively faster rotational speed results in a relatively higher shear force SH. A relatively higher shear force SH moves the flexible blade 24 farther from the coating transfer roll 18 which results in a larger spaced distance D and a correspondingly thicker layer 56. A relatively slower rotational speed results in a relatively lower shear force SH. A relatively lower shear force SH does not move the flexible blade 24 as far from the coating transfer roll 18 as the higher shear force. This results in a relatively smaller spaced distance D and a correspondingly thinner layer 56 and provides the benefit of controlling the thickness of the layer 56 by adjusting the roller speed in conjunction with adjustment of the pressure.

The viscosity of the selected coating material is also utilized to control the thickness of the layer 56. A higher viscosity coating material 20 induces a higher shear force to oppose the spring force. While a lower viscosity coating material 20 induces relatively lower shear force. Given this description, one of ordinary skill in the art will be able to recognize an appropriate combination of flexible blade 24 thickness, pressure, roller speed, and coating material viscosity to meet their particular needs.

The disclosed features provide the benefits of minimal wear on the flexible blade 24 and a consistent thickness of coating material 20 because the flexible blade 24 does not frictionally contact the coating transfer roll 18 during the coating operation. Therefore, there is minimal wear on the flexible blade 24.

The disclosed examples also allow the thickness of the thin layer 56 to be continually maintained on the order of $1\times10^{-4}$ inches or thinner, if desired, for selected thermoset coating materials. The disclosed example also provides for containment of the coating material because the flexible blade 24 simply restricts the amount of coating material 20 that is carried along the coating transfer roll 18 from within the coating material reservoir 22 rather than creating an overflow of coating material by removing excess coating material as in previously known coating machines.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A coating apparatus comprising:

a coating transfer roll having a cylindrical surface extending between two axial sides;

a flexible blade adjacent to said coating transfer roll;

a fluid source;

a pressurizable chamber for selectively deflecting said flexible blade, and said pressurizable chamber is in fluid communication with said fluid source;

a pair of reservoir wall members, one of said pair of reservoir wall members being sealed against one of the two axial sides of said coating transfer roll and the other of said pair of reservoir wall members being sealed against the other of the two axial sides of said coating transfer roll, wherein each of said pair of reservoir wall members comprises a bias member that biases said pair of reservoir wall members towards said coating transfer roll, wherein said bias members are spring-loaded fasteners; and a reservoir located above said flexible blade.

2. The apparatus as recited in claim 1, wherein said flexible blade comprises a flexible sheet that is moveable between an essentially flat configuration and a curved configuration.

3. The apparatus as recited in claim 1, wherein said flexible blade selectively exerts a spring force towards said coating transfer roll.

4. The apparatus as recited in claim 1, wherein said flexible blade comprises a metal sheet having a nominal thickness between 0.01 and 0.03 inches thick.

5. A coating apparatus comprising:

a coating transfer roll;

a blade that is moveable relative to said coating transfer roll;

a control; and an actuator in communication with said control, wherein the actuator selectively moves said blade in response to a rotational velocity of said coating transfer roll to control thickness of a coating applied to said coating transfer roll.

6. The apparatus as recited in claim 5, wherein said blade includes a first section that is fixed along an axis and a second section that is adjacent to said coating transfer roll and rotatable about said axis.

7. The apparatus as recited in claim 6, wherein said blade comprises a flexible blade and said second section rotates about said axis when said flexible blade deflects.

8. The apparatus as recited in claim 5, wherein said actuator comprises a pressurizable chamber that selectively applies a pressure to said blade.

9. The apparatus as recited in claim 1, wherein an upper wider portion of said reservoir tapers to a lower narrower portion.

10. The apparatus as recited in claim 1, wherein a pivot of said flexible blade is located above a moveable end of said flexible blade.

11. The apparatus as recited in claim 1, wherein said reservoir is located above a point of contact between said flexible blade and said coating transfer roll and below an upper most portion of said flexible blade.

12. The apparatus as recited in claim 1, wherein said pressurizable chamber is entirely within a housing at a first internal pressure of said pressurizable chamber and said pressurizable chamber protrudes from said housing at a second internal pressure of said pressurizable chamber that is greater than the first internal pressure.

13. The apparatus as recited in claim 1, wherein said pair of reservoir wall members are comprised of a low-friction polymer material.

14. The apparatus as recited in claim 1, wherein said pair of reservoir wall members are comprised of polytetrafluoroethylene.

* * * * *